US005323743A

United States Patent [19]

Kristiansson

[11] Patent Number: 5,323,743

[45] Date of Patent: Jun. 28, 1994

[54] SURE-START DEVICE FOR INTERNAL COMBUSTION ENGINES

[75] Inventor: Urban Kristiansson, Gothenburg, Sweden

[73] Assignee: AB Volvo, Gothenburg, Sweden

[21] Appl. No.: 940,888

[22] PCT Filed: Apr. 17, 1991

[86] PCT No.: PCT/SE91/00272

§ 371 Date: Dec. 17, 1992

§ 102(e) Date: Dec. 17, 1992

[87] PCT Pub. No.: WO91/16538

PCT Pub. Date: Oct. 31, 1991

[30] Foreign Application Priority Data

Apr. 23, 1990 [SE] Sweden ..... 9001440

[51] Int. Cl.[5] ..... F02N 11/04

[52] U.S. Cl. ..... 123/179.3; 123/179.28

[58] Field of Search ..... 123/179.3, 179.4, 179.28; 290/34

[56] References Cited

U.S. PATENT DOCUMENTS 3,762,387 10/1973 Blomberg et al. ..... 123/179.1

4,699,097 10/1987 Tanaka et al. ..... 123/192.1

FOREIGN PATENT DOCUMENTS 61-135937 6/1986 Japan .

61-155627 7/1986 Japan .

*Primary Examiner*—Andrew M. Dolinar

*Attorney, Agent, or Firm*—Young & Thompson

[57] ABSTRACT

A device for assuring start of an internal combustion engine (1) comprises an electrical machine (3) drivingly connected to the engine crankshaft (2). The machine can operate both as a motor and as a generator and it is controlled by a control unit (4) including a current director (8). With the aid of the control unit, the functions of the electrical machine can be switched between full generator function and full motor function within one rotation of the crankshaft to make possible full motor power during the compression stroke and full generator power during the power stroke.

1 Claim, 1 Drawing Sheet

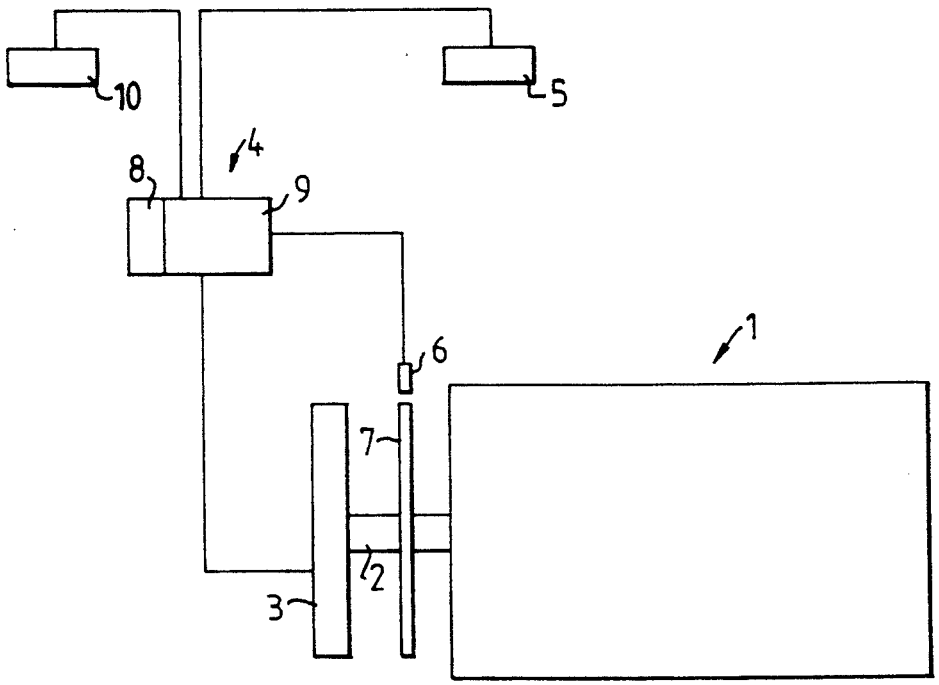
10
5
4
8
9
6
1
7
2
3

SURE-START DEVICE FOR INTERNAL COMBUSTION ENGINES

The present invention relates to a device for assuring start of an internal combustion engine, comprising an electrical machine drivingly connected to the engine crankshaft, an electrical energy source and means electrically coupled to the electrical machine and to the energy source, whereby the electrical machine can be controlled to operate either as a motor for starting the internal combustion engine or as a generator for supplying energy to the energy source when the engine is driving.

As an internal combustion engine is started, it passes through various phases before it can be considered to be fully started, i.e. when the engine is running so stably that there is no immediate risk of stalling. This state usually occurs within a few seconds after the engine has reached its set idling speed.

In order to start the engine, the starting system, usually consisting of a battery and a starter motor, must overcome both torque due to initial static friction and then torque due to kinetic friction and compression. Torque due to the initial static friction occurs until the crankshaft has begun to turn and the bearings etc become lubricated. Torque due to compression arises and increases as each piston approaches top dead center during its compression stroke. During the starting process, the starting system must be able to rotate the engine crankshaft sufficiently fast for a certain period of time, usually about 100 rpm for 5–10 seconds, in order that a sufficient amount of fuel for ignition will have time to reach the engine cylinders.

Immediately after start, when the idle speed has been reached, the engine will be running unevenly and the risk of stalling will be great. At this phase, a number of different factors can increase the risk of engine stalling, e.g. high load from the generator due to high charging requirement, compressor load by the air-conditioning being turned on during starting, the power steering unit etc.

Various arrangements are known for facilitating starting of an internal combustion engine and minimizing the risk of stalling after start. SE-A-334,778 describes, for example, a mechanical device for positioning the piston system of the engine in a position to facilitate starting. Known devices intended to prevent engine stalling as a result of too high engine load immediately after start comprise for example delay systems which delay engagement of the generator function and/or the air-conditioning compressor.

The purpose of the present invention is, with the aid of a combined starter motor and generator, which is known per se, to achieve a device which facilitates starting of an internal combustion engine and reduces the risk of engine stalling directly after start.

This is achieved according to the invention in a device of the type described by way of introduction by virtue of the fact that said means comprise a current director included in a control unit, which is coupled to a rotational speed and position sensor cooperating with the crankshaft of the engine, and that the control unit and the sensor are disposed, at a certain non-uniformity of engine crankshaft rotation speed, to cooperate to switch the function of the electrical machine between full motor function and full generator function within one rotation of the engine crankshaft.

The control unit can be a microprocessor which is programmed, when there is "uneven running" at low rpm, to control via the current director the electrical machine within the range full starter motor function to full generator function, so that the first function is obtained during the compression stroke and the latter function is obtained during the power stroke. When the engine is turned off, the sensor senses the crankshaft position and the control unit sends a signal to the current director to set, by means of the electrical machine, the crankshaft in a predetermined position so that the piston system is in the most advantageous alignment for the next start.

The invention will be described in more detail below with reference to an embodiment shown in the accompanying drawing, where the FIGURE is a block diagram of one embodiment of a device according to the invention.

In the FIGURE, 1 designates an internal combustion engine and 2 designates the engine crankshaft, to which an electrical machine 3 is coupled. In a preferred embodiment, the machine 3 is asynchronous, and its rotor (not shown) is solidly joined to the crankshaft 2, but other types of electrical machines can also be used provided that they can work both as motors and as generators. Instead of direct drive from the crankshaft, a suitable transmission can be used, e.g. a belt or gear transmission.

The machine 3 is connected via a control unit 4 to an energy source 5, e.g. an electrical accumulator or storage battery. The unit 4 is also connected to an inductive sensor 6, which is mounted in the immediate vicinity of a code disc 7 permanently mounted on the crankshaft. The code disc 7 can be of a type known per se, i.e. of the type used in fuel injection systems and consisting of a toothed disc with a certain non-uniformity in the distribution. Such a code means together with the inductive sensor sends pulses to the control unit from which both the crankshaft speed and its angular position can be determined.

The control unit 4 comprises a current director 8 and control hardware 9 connected to the sensor 6,7. This hardware can be a microprocessor and it receives continuous information concerning the running of the engine, i.e. rotational speed, rotational uniformity and angular position of the crankshaft. The microprocessor 9 is disposed to control the current director 8 in such a manner that when there is a certain non-uniformity in rpm, it will direct the electrical machine 3 to provide full motor power during the compression stroke and full generator power during the piston power stroke. During the strokes therebetween, the electrical machine can switch between these functions. This minimizes the risk of engine stalling immediately after start. The switching between the functions can also be used in normal engine operation, at least at lower rpm, to reduce engine vibration.

The control unit 4 is programmed when it receives information that the engine has stalled, to run the electrical machine 3 as a motor and set the crankshaft 2, and therefore the pistons, in a position which is conducive to restarting, i.e. in a position with as few pistons as possible within or near the compression stroke. This information can be obtained directly from the ignition lock 10 if the ignition is turned off, or from the sensor 6,7 if the rpm drops below a certain level.

The control unit 4 can be programmed when the engine is started to first cause the electrical machine 3 to slowly turn the crankshaft, slowly moving the pistons with it, and then accelerate the crankshaft up to the normal starting rpm. It can also be used as a "battery protector" by preventing, when there is a certain minimum voltage over the units governing ignition and fuel injection, engagement of certain current consumers, e.g. it can prevent engaging the motor function of the electrical machine.

I claim:

1. Device for assuring start of an internal combustion engine, comprising an electrical machine drivingly connected to the engine crankshaft, an electrical energy source and means electrically coupled to the electrical machine and to the energy source whereby the electrical machine can be controlled to operate either as a motor for starting the internal combustion engine or as a generator for supplying energy to the energy source when the engine is driving, said means comprising a current director (8) included in a control unit (4), which is coupled to a rotational speed and position sensor (6,7) cooperating with the crankshaft (2) of the engine (1), whereby the control unit and the sensor are disposed, at a certain non-uniformity of engine crankshaft rotational speed, to cooperate to switch the function of the electrical machine between full motor function and full generator function within one rotation of the engine crankshaft, characterized in that the control unit (49) is disposed to receive information from the sensor (6,7) or the ignition lock (10) indicating that the engine has stalled and upon receiving this information to control the current director (8) so that the electrical machine (3) positions the engine crankshaft (2) in a position wherein the piston system is favourably aligned for the next engine start.

* * * * *